US005778915A

United States Patent [19]

Zheng

[11] Patent Number: 5,778,915

[45] Date of Patent: Jul. 14, 1998

[54] COLLAPSIBLE STRUCTURES

[75] Inventor: Yu Zheng, Covina, Calif.

[73] Assignee: Patent Category Corporation, Monrovia, Calif.

[21] Appl. No.: 773,066

[22] Filed: Dec. 26, 1996

[51] Int. Cl.[6] ..... E04H 15/40

[52] U.S. Cl. ..... 135/126; 135/119; 135/125

[58] Field of Search ..... 135/125, 126, 135/128, 127, 130, 137, 143, 115, 119, 148, 149

[56] References Cited

U.S. PATENT DOCUMENTS

| | | | |
|---|---|---|---|
| 3,826,270 | 7/1974 | Hentges | 135/149 X |
| 3,847,170 | 11/1974 | Anderson | 135/143 X |
| 3,960,161 | 6/1976 | Norman . | |
| 3,990,463 | 11/1976 | Norman . | |
| 4,085,762 | 4/1978 | O'Brian et al. | 135/149 X |
| 4,590,956 | 5/1986 | Griesenbeck | 135/127 X |
| 4,825,892 | 5/1989 | Norman . | |
| 4,858,634 | 8/1989 | McLeese . | |
| 4,858,635 | 8/1989 | Eppenbach | 135/125 |
| 5,038,812 | 8/1991 | Norman . | |
| 5,249,592 | 10/1993 | Springer et al. | 135/126 |
| 5,370,145 | 12/1994 | Wu . | |
| 5,439,018 | 8/1995 | Tsai | 135/126 X |
| 5,467,794 | 11/1995 | Zheng . | |
| 5,560,385 | 10/1996 | Zheng . | |
| 5,562,115 | 10/1996 | Satelo | 135/137 X |
| 5,582,197 | 12/1996 | Dobberstein | 135/127 X |

FOREIGN PATENT DOCUMENTS

| | | | |
|---|---|---|---|
| 399025 | 6/1909 | France | 135/137 |
| 2635136 | 2/1990 | France . | |

*Primary Examiner*—Lanna Mai
*Attorney, Agent, or Firm*—Raymond Sun

[57] ABSTRACT

A collapsible structure has a base panel having separate first and second sides, and first and second wall panels, each having a bottom side connected to one of the sides of the base panel. Each panel further includes a foldable frame member having a folded and an unfolded orientation, and a fabric material substantially covering the frame member to form the panel when the frame member is in the unfolded orientation. The fabric assumes the unfolded orientation of its associated frame member. The first and second sides of the base panel rest on a surface when the structure is in its deployed configuration.

13 Claims, 10 Drawing Sheets

COLLAPSIBLE STRUCTURES

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the structures to facilitate convenient storage and use.

2. Description of the Prior Art

Collapsible structures have recently become popular with both adults and children. Examples of such structures are shown and described in U.S. Pat. Nos. 5,038,812 (Norman), 5,467,794 (Zheng) and 5,560,385 (Zheng). These structures may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

SUMMARY OF THE DISCLOSURE

The present invention provides a collapsible structure which is convenient to use, to transport, and to store, and which offers a wide variety of uses to the user.

In order to accomplish the objects of the present invention, the collapsible structure according to the present invention includes a base panel having separate first and second sides, and first and second wall panels, each having a bottom side connected to one of the sides of the base panel, and a top side. Each panel further includes a foldable frame member having a folded and an unfolded orientation, and a fabric material substantially covering the frame member to form the panel when the frame member is in the unfolded orientation. The fabric assumes the unfolded orientation of its associated frame member. The first and second sides of the base panel rest on a surface when the structure is in its deployed configuration.

In a first embodiment, a removable attachment mechanism removably connects the bottom side of the first wall panel to the first side of the base panel. The structure has a first end defined by a first end edge of the base panel, and left sides of the first and second wall panels. A fabric covering is attached to the first end edge of the base panel, and the left sides of the first and second wall panels to substantially cover the first end of the structure. A slit is provided in the fabric covering to create an opening in the fabric covering to provide ingress and egress to the interior of the structure. The slit defines two separate portions that have free and unconnected bottom edges.

In a second embodiment, the structure further includes a top panel having a first side connected to a top side of the first wall panel, and a second side connected to a top side of the second wall panel. The structure includes a first end defined by first end edges of the base and top panels, and left sides of the first and second wall panels. The first end of the structure has four corners, with a fabric piece attached to each of the four corners.

In a third embodiment, the structure further includes a first top panel having a first side and a second side, and a second top panel having a first side connected to a top side of the second wall panel, and a second side connected to the first side of the first top panel. A removable attachment mechanism removably connects the second side of the first top panel and a top side of the first wall panel to each other.

In a fourth embodiment, the structure further includes a first top panel having a first side connected to a top side of the first wall panel, and a second top panel having a first side connected to a top side of the second wall panel. A removable attachment mechanism removably connects the second sides of the first and second top panels to each other.

The structures according to the present invention provide, frame retaining sleeves along each panel for retaining the frame member for each panel. The present invention also provides that one or more adjacent sides of adjacent panels are hingedly connected to each other. The hinged connection can be accomplished in one of a variety of methods. According to a first method, the frame retaining sleeves of adjacent panels are stitched together. According to a second method, an interconnecting fabric is stitched to the frame retaining sleeves and fabric material of adjacent panels. According to a third method, an interconnecting fabric is stitched to the fabric material of adjacent panels. According to a fourth method, an interconnecting fabric is stitched to the frame retaining sleeves and fabric material of adjacent panels at spaced-apart locations along the interconnecting fabric. According to a fifth method, a sleeve assembly is connected to the fabric materials of adjacent panels, the sleeve assembly having two sleeve compartments, defined by a divider portion, for retaining the frame members of adjacent panels. According to a sixth method, the fabric materials of adjacent panels are connected by stitchings to the opposing ends of the frame retaining sleeves. According to a seventh method, each frame retaining sleeve of adjacent panels converges to form one sleeve portion for retaining and hinging adjacent frame members.

The collapsible structures according to the present invention are convenient for use since they are easily and quickly folded and collapsed into a smaller size for transportation and storage.

DETAILED DESCRIPTION OF THE PREFERRED EMBODIMENTS

Figure 1:
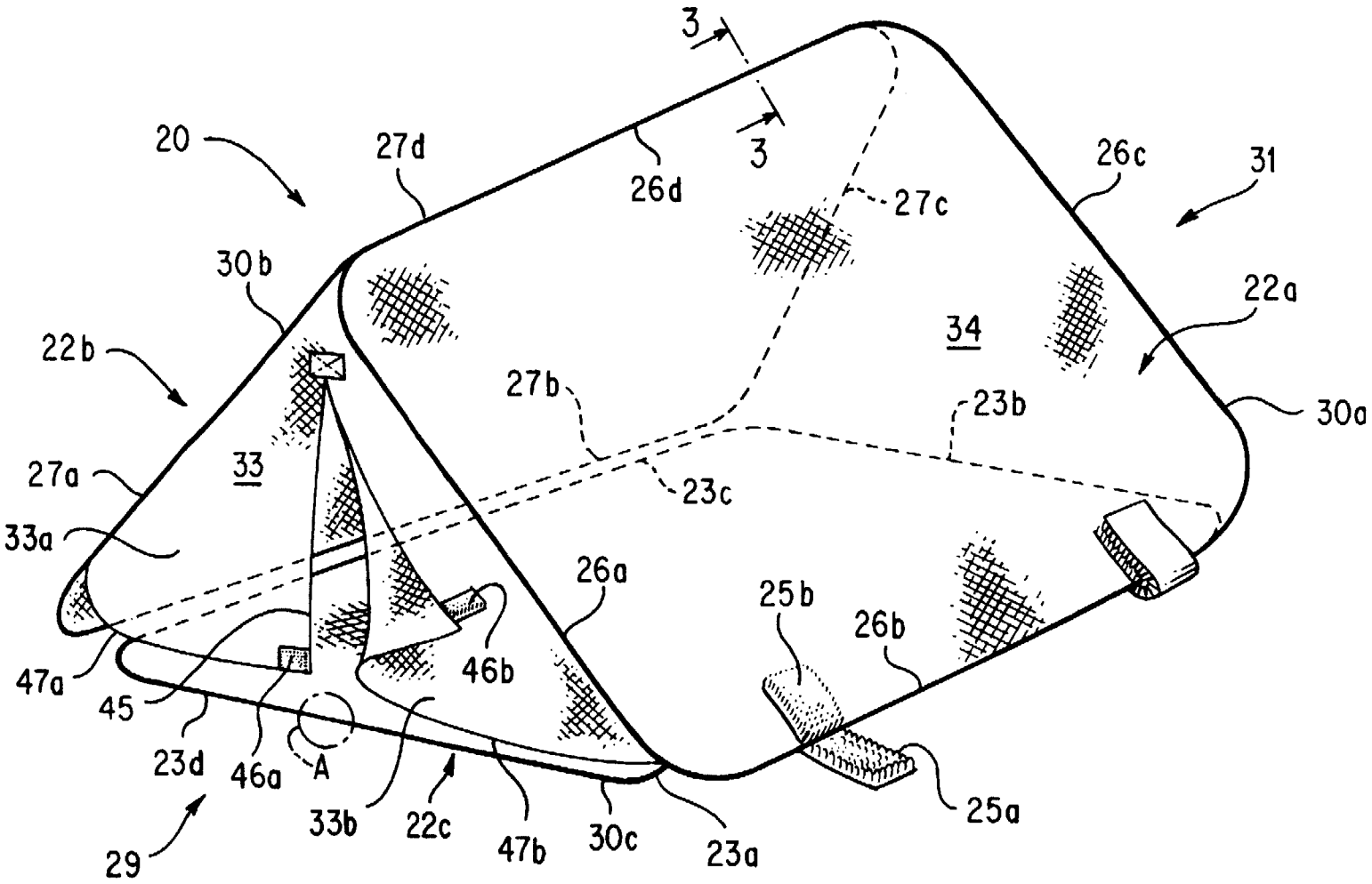
FIG. 1 is a perspective view of a collapsible structure according to a first preferred embodiment of the present invention shown in use in its expanded configuration.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

A first embodiment of the present invention is illustrated in connection with FIGS. 1 and 2. A collapsible structure 20 has three panels 22*a*, 22*b* and 22*c*, with a base panel 22*c* hingedly connected to a wall panel 22*b*, which is in turn hingedly connected to another wall panel 22*a* to form an enclosed space therewithin.

Each panel 22*a*, 22*b* and 22*c* has four side edges. The base panel 22*c* has two opposing side edges 23*a* and 23*c*, each having opposing ends connected to one of two opposing end edges 23*b* and 23*d*. The wall panel 22*a* has a left side edge 26*a*, a bottom side edge 26*b*, a right side edge 26*c*, and a top side edge 26*d*, while the wall panel 22*b* has a left side edge 27*a*, a bottom side edge 27*b*, a right side edge 27*c*, and a top side edge 27*d*. Each panel 22*a*, 22*b* and 22*c* has a continuous frame retaining sleeve 30*a*, 30*b* or 30*c* provided along and traversing the four edges of its four sides. A continuous frame member 32*a*, 32*b* or 32*c* is retained or held within each frame retaining sleeve 30*a*, 30*b* or 30*c*, respectively, to support each panel 22*a*, 22*b* and 22*c*. Only the frame member 32*c* is shown in FIG. 2; the other frame members 32*a* and 32*b* are not shown but are the same as frame member 32*c*.

The continuous frame members 32*a*, 32*b* and 32*c* may be provided as one continuous loop, or may be a strip of material connected at both ends to form a continuous loop. The continuous frame members 32*a*, 32*b* and 32*c* are preferably formed of flexible coilable steel, although other materials such as plastics may also be used. The frame members 32*a*, 32*b* and 32*c* should be made of a material which is relatively strong and yet is flexible to a sufficient degree to allow it to be coiled. Thus, each frame member 32*a*, 32*b* and 32*c* is capable of assuming two positions, an open or expanded position such as shown in FIG. 1, or a folded position in which the frame member is collapsed into a size which is much smaller than its open position (see FIG. 5E).

The frame members 32*a*, 32*b* and 32*c* may be merely retained within the respective frame retaining sleeves 30*a*, 30*b* and 30*c* without being connected thereto. Alternatively, the frame retaining sleeves 30*a*, 30*b* and 30*c* may be mechanically fastened, stitched, fused, or glued to the frame members 32*a*, 32*b* and 32*c*, respectively, to retain them in position.

Fabric or sheet material 34 extends across each panel 22*a*, 22*b* and 22*c*, and is held taut by the respective frame members 32*a*, 32*b* and 32*c* when in its open position. The term fabric is to be given its broadest meaning and should be made from strong, lightweight materials and may include woven fabrics, sheet fabrics or even films. The type of fabric used will depend on the intended application. For example, a stronger and more durable fabric will be used if the structure is intended for outdoor use, such as for camping. The fabric should be water-resistant and durable to withstand the wear and tear associated with rugged outdoor use or rough treatment by children.

Referring to FIG. 1, the bottom side edge 27*b* of wall panel 22*b* is hingedly connected to side edge 23*c* of the base panel 22*c*, and the top side edge 27*d* of wall panel 22*b* is hingedly connected to the top side edge 26*d* of wall panel 27*a*. The bottom side edge 26*b* of wall panel 22*a*is removably connected to the side edge 23*a* of base panel 22*c* by a conventional attachment mechanism, such as one or more pairs of opposing velcro pads 25*a* and 25*b* that are provided along edges 23*a* and 26*b*, respectively. Other conventional attachment mechanisms, such as but not limited to hooks, fasteners, buttons, snap-fit engagements, loops, snap buckles, zippers and ties, can also be used without departing from the spirit and scope of the present invention.

The two opposing ends 29 and 31 of the structure 20 are provided with a fabric covering. The fabric covering 33 interconnects the left side edges 26*a* and 27*a* of the wall panels 22*a* and 22*b*, respectively, and a similar fabric covering interconnects the right side edges 26*c* and 27*c* of the wall panels 22*a* and 22*b*, respectively. A slit 45 is provided in fabric covering 33 and defines two fabric portions 33*a* and 33*b*. The bottom edges 47*a* and 47*b* of the portions 33*a* and 33*b* are not connected to the edge 23*d* of base panel 22*c*. Therefore, the slit 45 functions to create an opening to provide ingress and egress to the interior of the structure 20. Velcro pads 46*a* and 46*b* are provided on the fabric portions 33*a* and 33*b* to secure the portions 33*a* and 33*b* together to close the opening.

The words "hingedly connected" or "hinged connection" when used herein means permanently connecting or attaching two adjacent sides of adjacent panels in a manner in which the connection is not intended to be dis-connected during normal use of the structure. FIG. 3A illustrates one preferred method for hingedly connecting top side edge 27*d* of wall panel 22*b* and the top side edge 26*d* of wall panel 22*a*. The fabric pieces 34*a* (for panel 22*a*) and 34*b* (for panel 22*b*) are folded over at their edges at the edges 26*a*, 26*c*, 27*a* and 27*c* to define the respective sleeves 30*a* and 30*b* in the manner described below in connection with FIG. 2. The fabric pieces 34*a* and 34*b* are stitched at their edges by a stitching 36 to the respective sleeves 30*a* and 30*b*. Each sleeve 30*a* and 30*b* may be formed by folding a piece of fabric and having its ends connected by stitching 36. The stitching 36 also acts as a hinge for the panels 22*a* and 22*b* to be folded upon each other, as explained below.

Figure 3A:
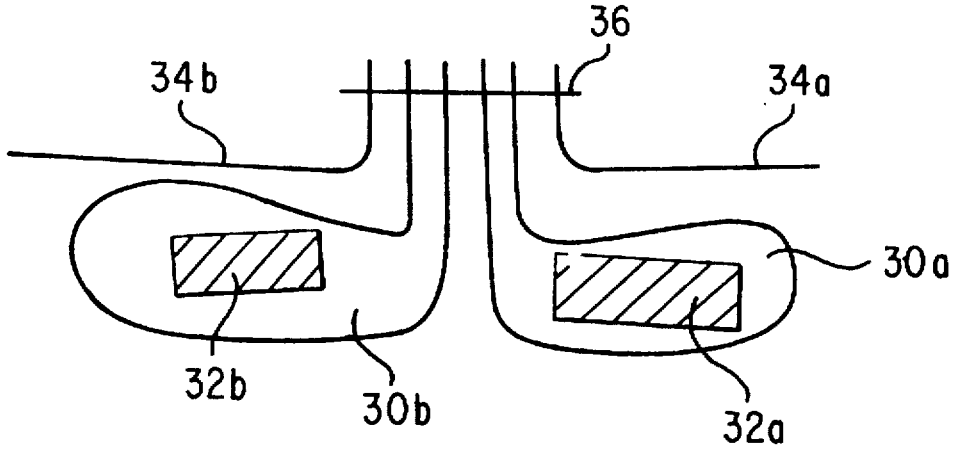
FIGS. 3A–3F and 4 are cross-sectional views of seven different preferred connections between two adjacent panels of the structure of FIG. 1 taken along line 3—3 thereof.
Figure 3B:
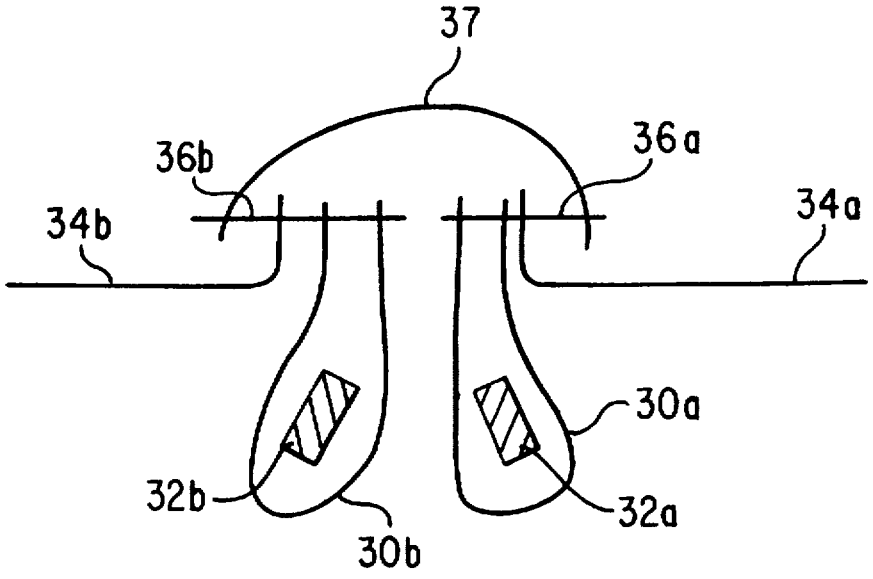

FIG. 3B illustrates a second preferred method for hingedly connecting top side edge 27*d* of wall panel 22*b* and the top side edge 26*d* of wall panel 22*a*. The fabric piece 34*a* and its sleeve 30*a* are stitched by a stitching 36*a* to one end of an interconnecting fabric piece 37, and the fabric piece 34*b* and its sleeve 30*b* are stitched by another stitching 36*b* to another end of the interconnecting fabric piece 37, which therefore acts as an interconnecting hinge for the panels 22*a* and 22*b*.

Figure 3C:
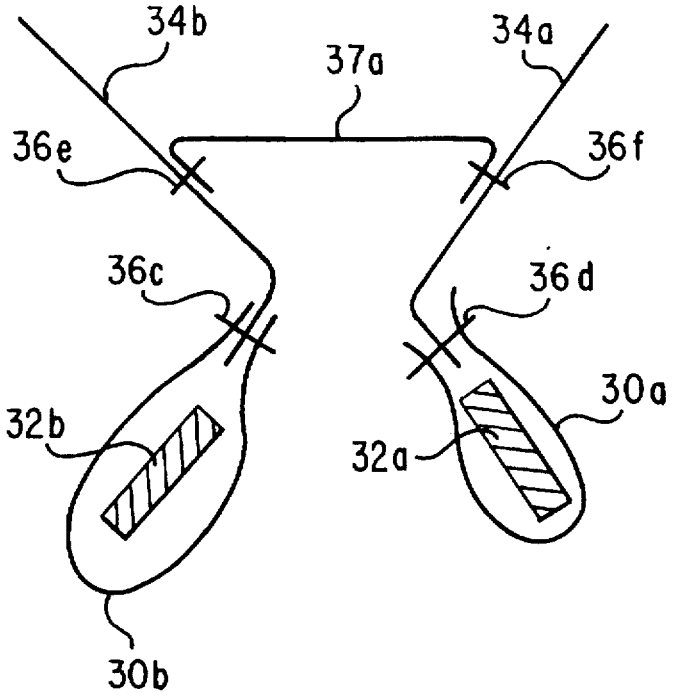

FIG. 3C illustrates a third preferred method for hingedly connecting top side edge 27*d* of wall panel 22*b* and the top side edge 26*d* of wall panel 22*a*. The fabric piece 34*a* and its sleeve 30*a* are connected by a stitching 36*d*, and the fabric piece 34*b* and its sleeve 30*b* are connected by another stitching 36*c*. An interconnecting fabric piece 37*a* is connected to fabric pieces 34*a* and 34*b* by stitchings 36*f* and 36*e*, respectively, at locations offset interiorly from the sleeves 30*a* and 30*b*. The interconnecting fabric piece 37*a* therefore acts as an interconnecting hinge for the panels 22*a* and 22*b*.

Figure 3E:
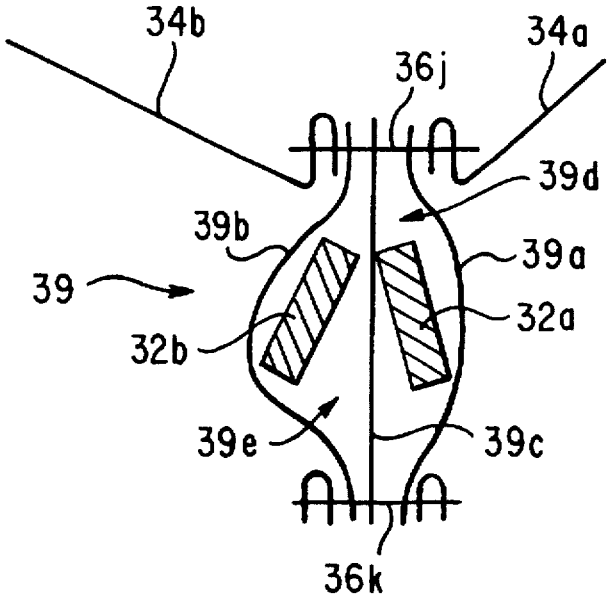
Figure 3D:
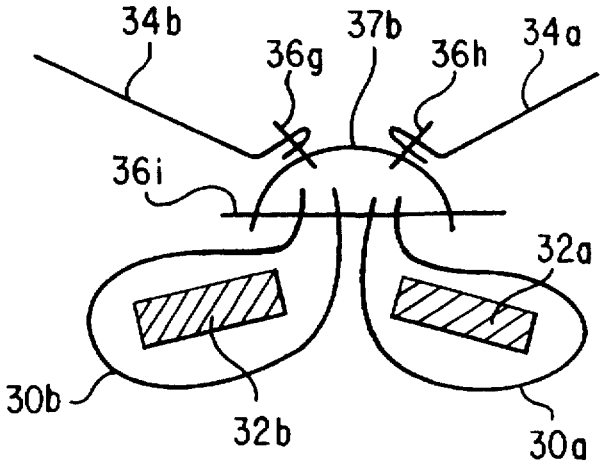

FIG. 3D illustrates a fourth preferred method for hingedly connecting top side edge 27*d* of wall panel 22*b* and the top side edge 26*d* of wall panel 22*a*. The fabric pieces 34*a* and 34*b* are connected by stitchings 36*h* and 36*g*, respectively, to spaced-apart locations of interconnecting fabric piece 37*b*. Interconnecting fabric piece 37*b* is in turn connected, at both its ends by stitching 36*i*, to sleeves 30*a* and 30*b*. Thus, the interconnecting fabric piece 37*b* acts as an interconnecting hinge for the panels 22*a* and 22*b*, and actually connects sleeves 30*a*, 30*b* and fabric pieces 34*a*, 34*b*.

FIG. 3E illustrates a fifth preferred method for hingedly connecting top side edge 27*d* of wall panel 22*b* and the top side edge 26*d* of wall panel 22*a*. The frame retaining sleeves 30*a* and 30*b* converge at, or are connected to, one sleeve assembly 39 which is connected to the fabric pieces 34*a* and 34*b* by stitching 36*j*. The sleeve assembly 39 has two sleeve compartments 39*d* and 39*e* for holding frame members 32*a* and 32*b*, respectively. The sleeve compartments 39*d* and 39*e* are formed by stitching the opposing ends of three sleeve portions 39*a*, 39*b* and 39*c* through the use of stitchings 36*j* and 36*k*. The sleeve portion 39*c* acts both as a divider and to define the sleeve compartments 39*d* and 39*e*. The stitching 36*j* acts as an interconnecting hinge for the panels 22*a* and 22*b*.

Figure 3F:
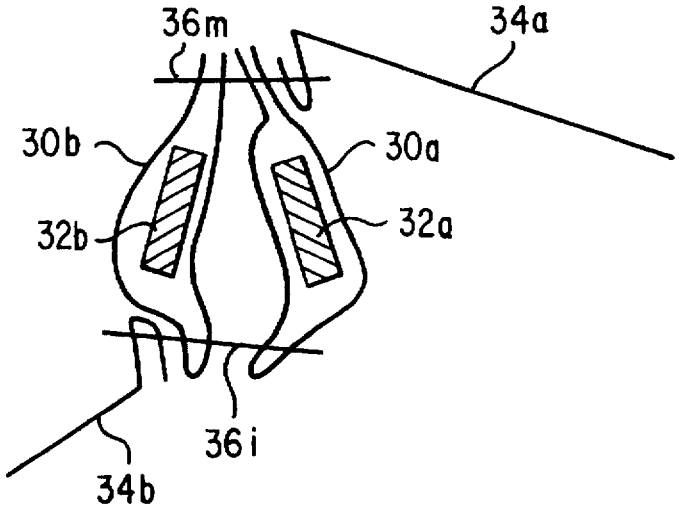

FIG. 3F illustrates a sixth preferred method for hingedly connecting top side edge 27*d* of wall panel 22*b* and the top side edge 26*d* of wall panel 22*a*. The fabric piece 34*b* is connected by stitching 36*l* to one end of sleeves 30*a* and 30*b*, and the fabric piece 34*a* is connected by stitching 36*m* to the opposing end of sleeves 30*a* and 30*b*. The sleeves 30*a* and 30*b* are formed by stitching the opposing ends of two sleeve portions with the stitchings 36*l* and 36*m*. Thus, the stitchings 36*l* and 36*m* act as interconnecting hinges for panels 22*a* and 22*b*.

Figure 4:
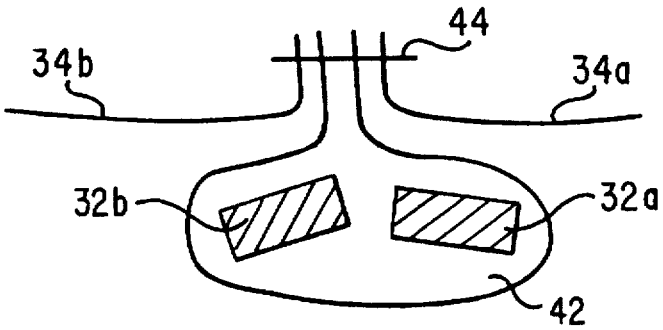

FIG. 4 illustrates a seventh preferred method for hingedly connecting top side edge 27*d* of wall panel 22*b* and the top side edge 26*d* of wall panel 22*a*. However, the frame retaining sleeves 30*a* and 30*b* converge at, or are connected to, one sleeve portion which interconnects panels 22*a* and 22*b* to form a singular frame retaining sleeve 42 which retains the frame members 32*a* and 32*b*. Sleeve 42 may be formed by providing a tubular fabric, or by folding a piece of fabric, and applying a stitching 44 to its edges to connect the sleeve 42 to the fabric pieces 34*a* and 34*b*. Stitching 44 acts as an interconnecting hinge for the panels 22*a* and 22*b*.

Figure 2:
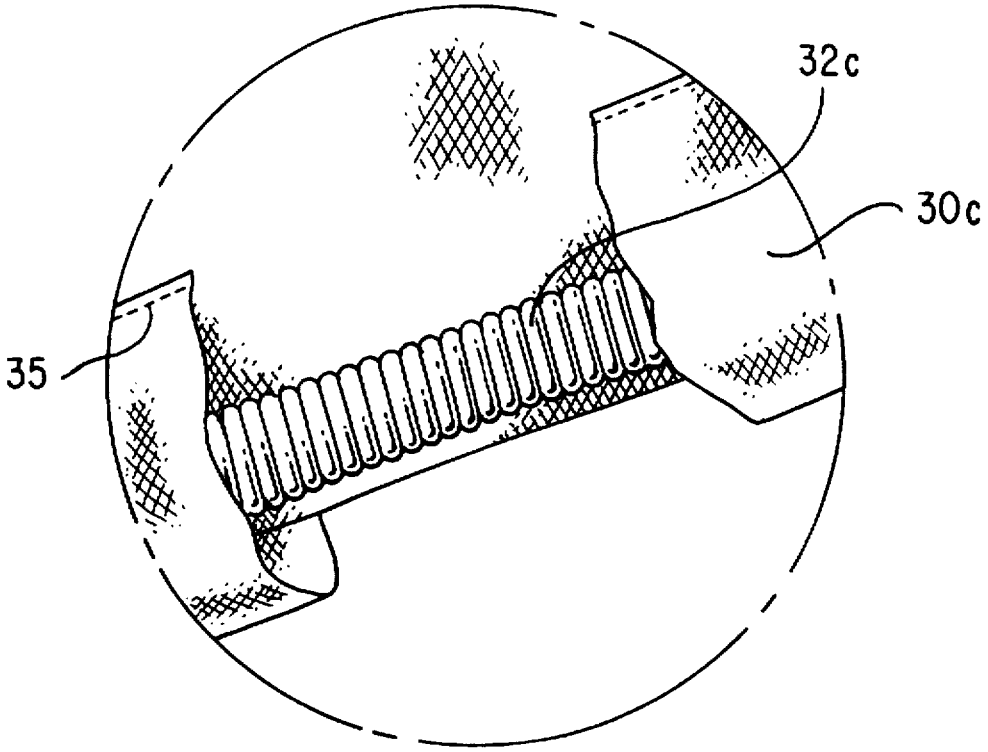
FIG. 2 is a partial cut-away view of the section A of the structure of FIG. 1 illustrating a frame member retained within a sleeve.

For the embodiments of FIGS. 3A–3F and 4, at the edges 23*d*, 23*b*, 26*a*, 26*c*, 27*a* and 27*c* which are not hingedly connected to another edge, the frame retaining sleeve 30*a*, 30*b* or 30*c* may be formed by merely folding over the corresponding fabric piece and applying a stitching 35 (see FIG. 2). Instead, the fabric portion 33*a* is connected to edge 27*a*, and the fabric portion 33*b* is connected to edge 26*a*, by stitching the fabric portions 33*a* and 33*b* to the frame retaining sleeves 30*a* or 30*b*. The fabric covering at the end 31 is likewise attached by stitching the edges of the fabric covering to the frame retaining sleeves 30*a* and 30*b* while leaving the bottom edges unconnected. A slit is optional at the end 31.

Although only the connection of the edges 26*d* and 27*d* is illustrated in FIGS. 3A–3F and 4, the side edge 23*c* of base panel 22*c* and the bottom side edge 27*b* of wall panel 22*b* may be hingedly connected by using one of the methods described above, or by a combination of any of these methods.

It will also be appreciated by those skilled in the art that the removable connections achieved by the attachment mechanisms described above can also act as hinges between adjacent side edges of adjacent panels. The difference between the removable connections and the hinge connections is that the removable connections can be detached without destroying the ability of re-attaching the connection using the same attachment mechanism.

Openings (not shown) may be provided in some or all of the panels 22*a*, 22*b* and 22*c*. These openings may be of any shape (e.g., triangular, circular, rectangular, square, diamond, etc.) and size and are designed and dimensioned to allow the user to crawl through them to enter or to exit the structure 20.

To assemble the structure 20 of FIG. 2 to the fully deployed configuration shown in FIG. 1, the user first rests all three panels 22*a*, 22*b* and 22*c* on the ground or surface. Using the panel 22*c* as a base, the user folds the wall panel 22*b* upwardly about its hinge connection (between side edges 23*c* and 27*b*) with the base panel 22*c* and then wraps or folds the wall panel 22*a* about its hinge connection (between side edges 26*d* and 27*d*) with wall panel 22*b* so that bottom side edge 26*b* of wall panel 22*a* is adjacent side edge 23*a* of base panel 22*c*. The user manually connects the side edges 26*b* and 23*a* by connecting the attachment mechanism, such as the opposing velcro pads 25*a* and 25*b*.

Figure 5A:
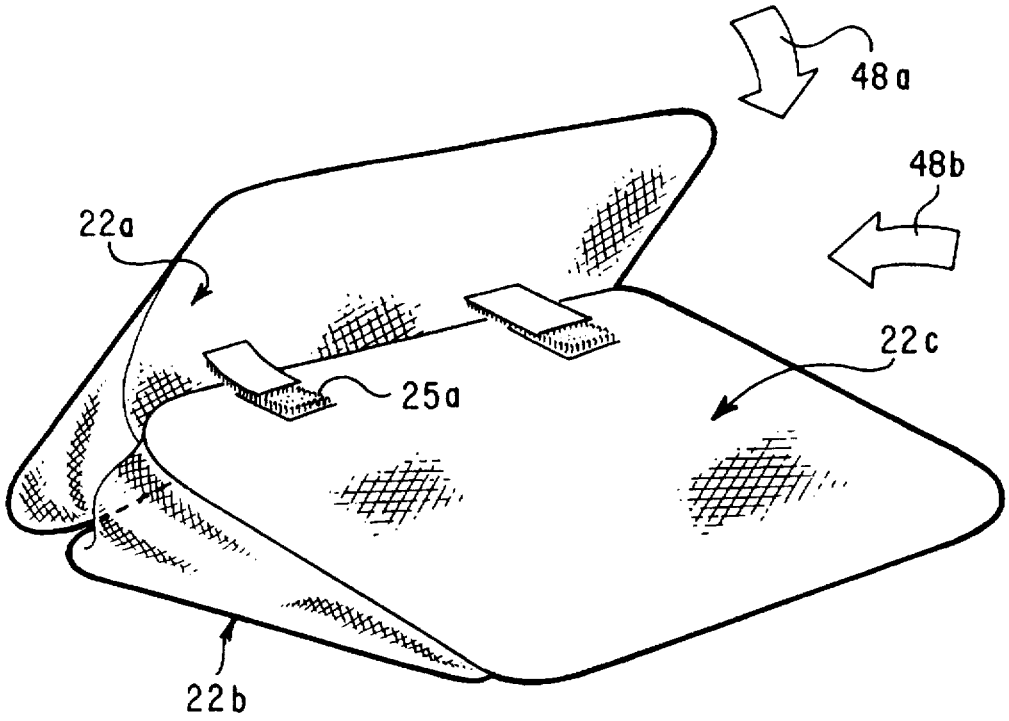
FIGS. 5(A) through 5(E) illustrate how the structure of FIG. 1 may be twisted and folded for compact storage.
Figure 5B:
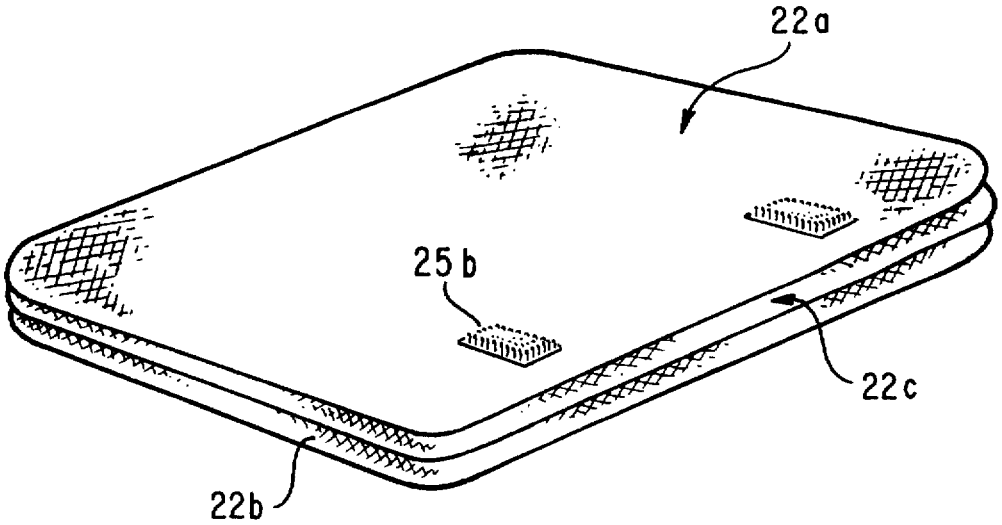

FIGS. 5A through 5E describe the steps for disassembling and collapsing the structure 20 into a compact configuration for storage. In the first step, the user detaches the attachment mechanism between side edges 26*b* and 23*a*. The three panels 22*a*, 22*b* and 22*c* are then laid flat on the ground. As illustrated in FIG. 5A, panel 22*c* is folded about its hinge connection between edges 23*c* and 27*b* so that panel 22*c* is folded onto and overlies the panel 22*b*, as indicated by the arrow 48*b*. Panel 22*a* is then folded about its hinge connection between edges 26*d* and 27*d* so that panel 22*a* is folded onto and overlies the panel 22*c*, as indicated by the arrow 48*a*, so that the three panels 22*a*, 22*b* and 22*c* now rest one on top of the other in a stack (see FIG. 5B). The structure is then ready to be twisted and folded to collapse the frame members and panels into a smaller shape.

Figure 5C:
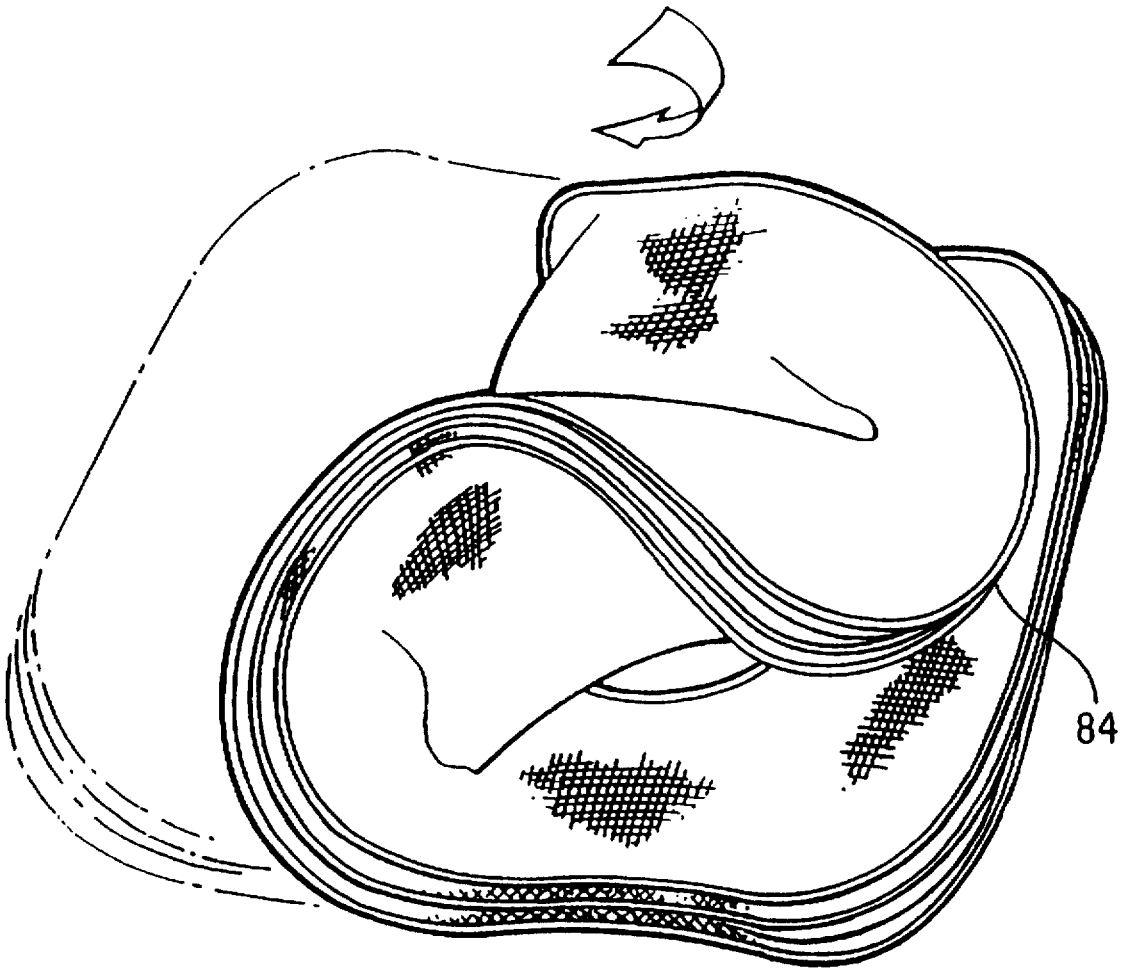
Figure 5D:
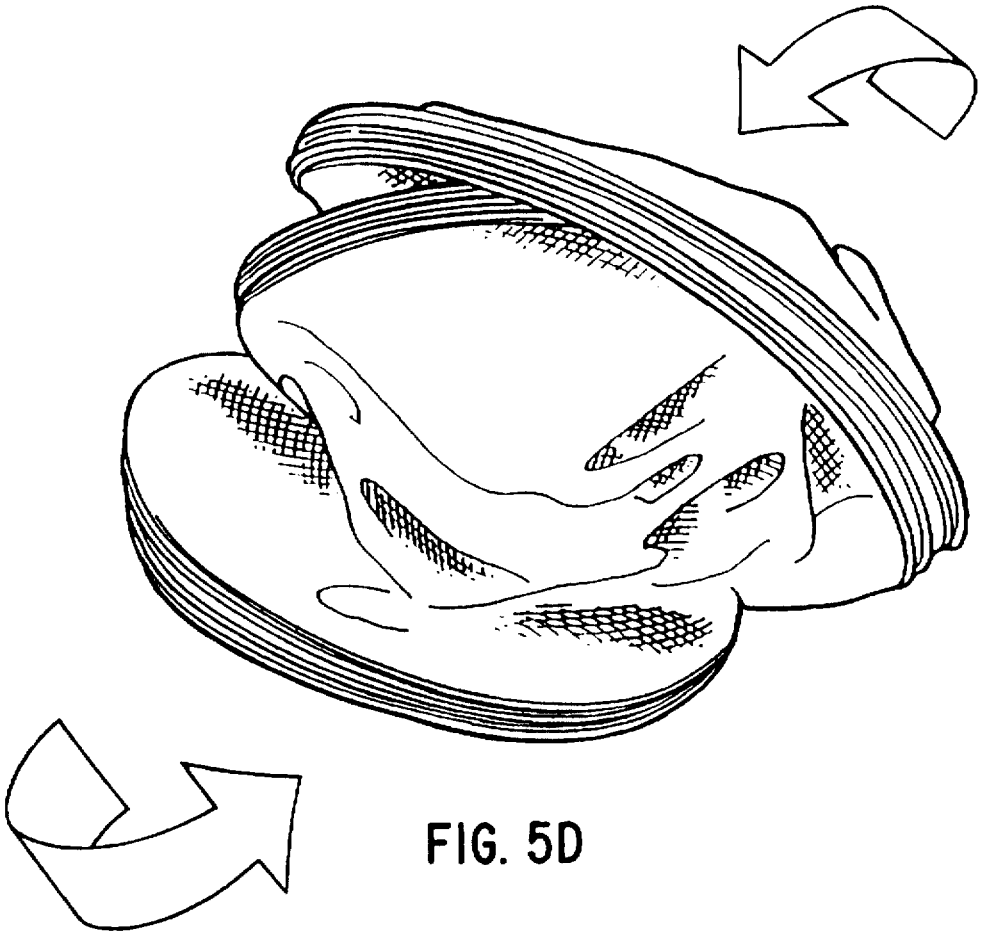
Figure 5E:
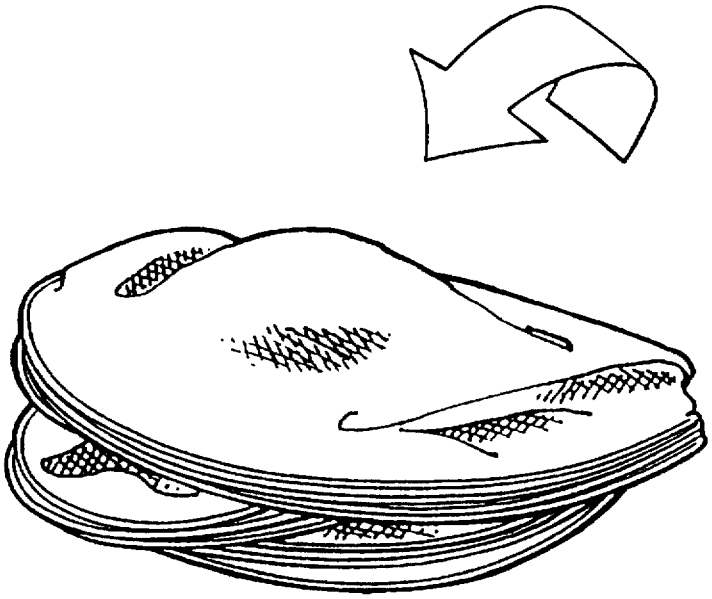

In the second step shown in FIG. 5C, the opposite border 84 of the structure 20 is folded in upon the previous fold to further collapse the frame members with the panels. As shown in FIG. 5D, the third step is to continue the collapsing so that the initial size of the structure is reduced. FIG. 5E shows the fourth step with the frame members and panels collapsed on each other to provide for a small essentially compact configuration having a plurality of concentric frame members and fabric layers of the panels so that the collapsed structure has a size which is a fraction of the size of the initial structure. During the folding and collapsing steps of FIGS. 5A–5E, the fabric coverings, such as 33, are tucked between the panels and folded and collapsed together with the panels.

Figure 6:
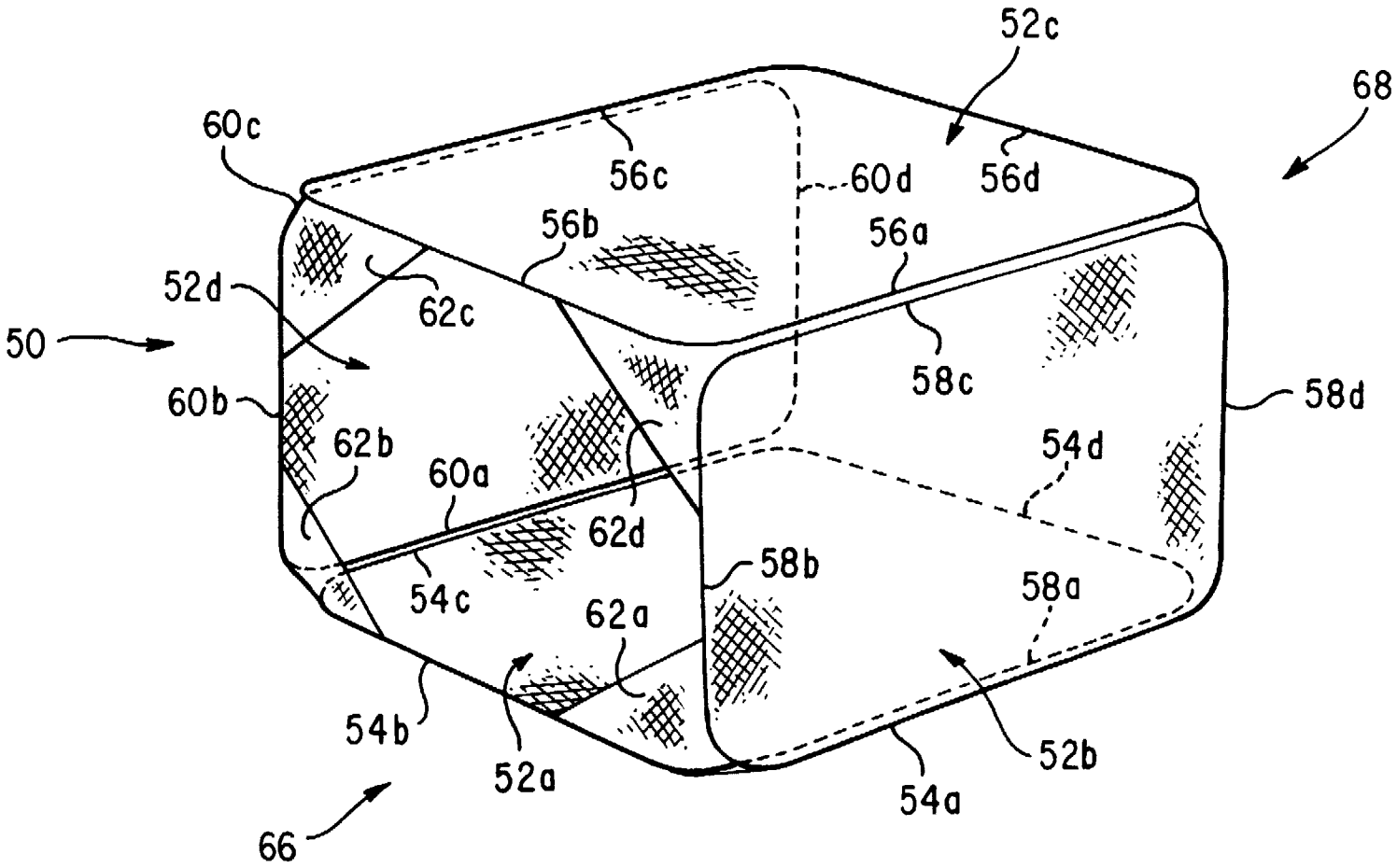
FIG. 6 is a perspective view of a collapsible structure according to a second preferred embodiment of the present invention shown in use in its expanded configuration.

A second preferred embodiment of the present invention is shown in FIG. 6. The structure 50 has four panels, a base panel 52*a*, wall panels 52*b* and 52*d*, and a top panel 52*c* hingedly connected to each other to encircle an enclosed space. Each panel 52*a*, 52*b*, 52*c* and 52*d* has four sides.

Specifically, the base panel 52*a* has two side edges 54*a* and 54*c*, and two end edges 54*b* and 54*d*. The top panel 52*c* likewise has two side edges 56*a* and 56*c*, and two end edges 56*b* and 56*d*. The wall panel 52*b* has a bottom edge 58*a*, a left edge 58*b*, a top edge 58*c* and a right edge 58*d*. Similarly, the wall panel 52*d* has a bottom edge 60*a*, a left edge 60*b*, a top edge 60*c* and a right edge 60*d*. The structure of each panel 52*a*, 52*b*, 52*c* and 52*d*, including their fabric, frame members and sleeve portions, is the same as the panels 22*a*, 22*b* and 22*c* of the play structure 20, except that the shapes and sizes of the panels 52 may be different from the shapes and sizes of the panels 22.

Opposing side edges 54*a* and 54*c* of base panel 52*a* are hingedly connected to bottom edges 58*a* and 60*a* of wall panels 52*b* and 52*d*, respectively. Opposing side edges 56*a* and 56*c* of top panel 52*c* are hingedly connected to top edges 58*c* and 60*c* of wall panels 52*b* and 52*d*, respectively. The hinged connections of the side edges of the structure 50 may be accomplished by the hinge connection mechanisms described above for the structure 20.

Triangular fabric pieces 62*a*, 62*b*, 62*c* and 62*d* are stitched or otherwise connected to each of the four corners at opposite ends 66 and 68 of the structure 50. For example, fabric piece 62*a* is connected to the corner defined by the left edge 58*b* of wall panel 52*b* and end edge 54*b* of base panel 52*a*. Fabric piece 62*b* is connected to the corner defined by the left edge 60*b* of wall panel 52*d* and end edge 54*b* of base panel 52*a*. Fabric piece 62*c* is connected to the corner defined by the left edge 60*b* of wall panel 52*d* and end edge 56*b* of top panel 52*c*. Fabric piece 62*d* is connected to the corner defined by the left edge 58*b* of wall panel 52*b* and end edge 56*b* of top panel 52*c*. Therefore, the end 66 of structure 50 is substantially open. Similar fabric pieces may be provided at the opposite end 68 of the structure 50, or that end 68 may be completely closed off by stitching a piece of fabric to the edges 54*d*, 56*d*, 58*d* and 60*d*.

Alternatively, pieces of fabric acting as wall pieces can be attached to both ends 66 and 68 to close off both ends, with openings or slits provided in one or both of these fabric wall pieces, or in one or more of the panels 52*a*, 52*b*, 52*c* and 52*d*, to provide ingress and egress.

The structure 50 is preferably provided in the configuration shown in FIG. 6. To fold and collapse the structure 50 into a compact configuration for storage or transportation, panels 52*b* and 52*c* are pushed against panels 52*a* and 52*d*, respectively, about their hinged connections so that panels 52*b* and 52*c* rest against or overlie panels 52*a* and 52*d*, respectively. This folding action is facilitated by the hinge connections between adjacent side edges of adjacent panels. Two of the overlying panels 52*b* and 52*a*, or 52*c* and 52*d*, are then folded about their hinge connections onto the other two overlying panels, so that the four panels 52*a*, 52*b*, 52*c* and 52*d* overlie each other in a stack. The combined stack of panels are then twisted and folded in the manner described above in connection with FIGS. 5A–5E to collapse the structure 50 into a compact configuration.

Figure 7:
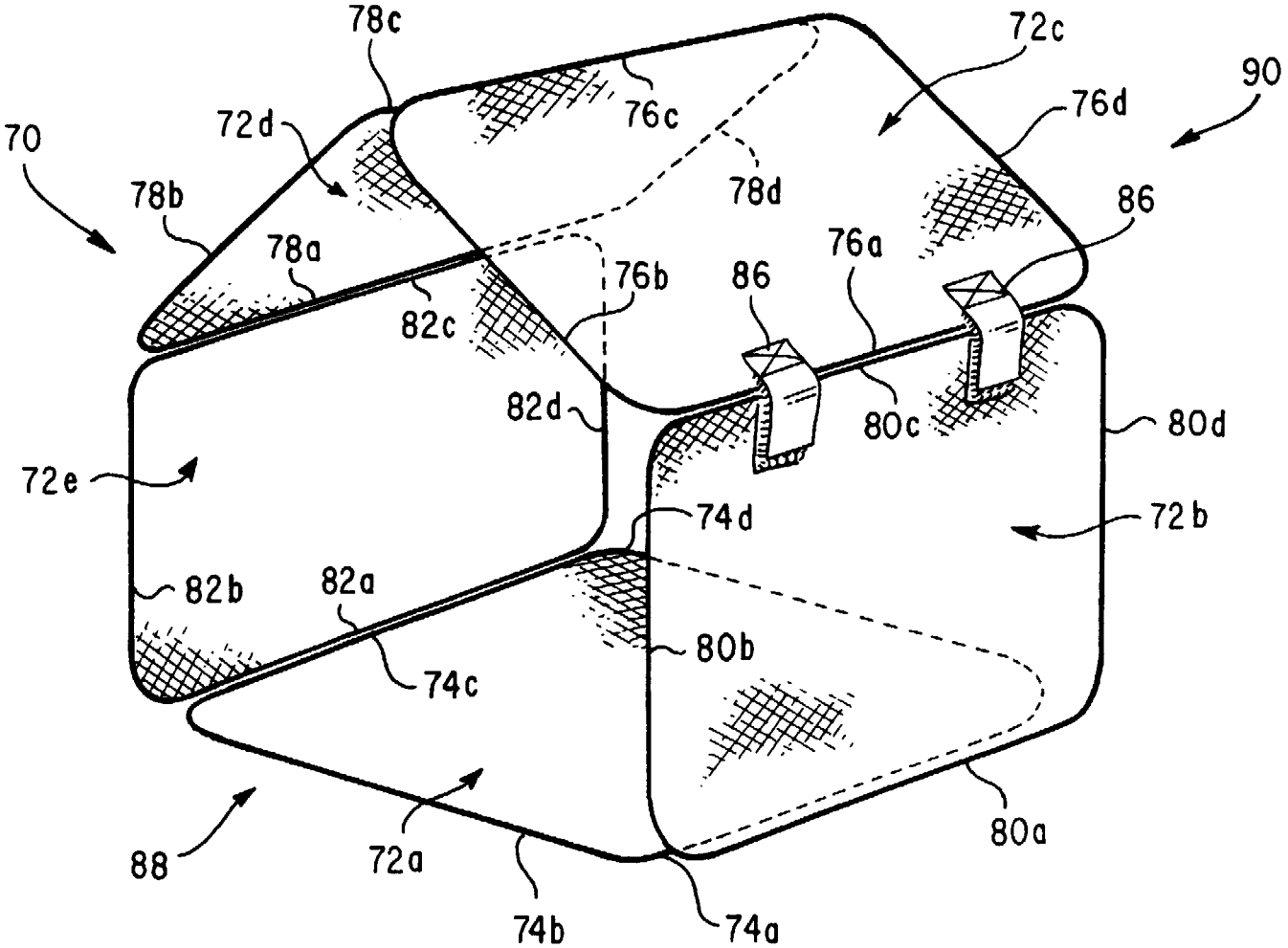
FIG. 7 is a perspective view of a collapsible structure according to a third preferred embodiment of the present invention shown in use its expanded configuration.

A third preferred embodiment of the present invention is shown in FIG. 7. A structure 70 has five panels: a base panel 72*a*, wall panels 72*b* and 72*e*, and top panels 72*c* and 72*d* connected to each other to encircle an enclosed space. Each panel 72*a*, 72*b*, 72*c*, 72*d* and 72*e* has four sides. Specifically, the base panel 72*a* has two side edges 74*a* and 74*c*, and two end edges 74*b* and 74*d*. The top panels 72*c* and 72*d* likewise have two side edges 76*a*, 76*c* and 78*a*, 78*c*, respectively, and two end edges 76*b*, 76*d* and 78*b*, 78*d*, respectively. The wall panel 72*b* has a bottom edge 80*a*, a left edge 80*b*, a top edge 80*c* and a right edge 80*d*. Similarly, the wall panel 72*e* has a bottom edge 82*a*, a left edge 82*b*, a top edge 82*c* and a right edge 82*d*. The structure of each panel 72*a*, 72*b*, 72*c*, 72*d* and 72*e*, including their fabric, frame members and sleeve portions, is the same as the panels 22*a*, 22*b* and 22*c* of the play structure 20, except that the shapes and sizes of the panels 72 may be different from the shapes and sizes of the panels 22.

Opposing side edges 74*a* and 74*c* of base panel 72*a* are hingedly connected to bottom edges 80*a* and 82*a* of wall panels 72*b* and 72*e*, respectively. Top edge 82*c* of wall panel 72*e* is hingedly connected to side edge 78*a* of top panel 72*d*. Side edge 78*c* of top panel 72*d* is hingedly connected to side edge 76*c* of top panel 72*c*. The hinged connections of the side edges of the structure 70 may also be accomplished by the hinge connection mechanisms described above for the structure 20.

Top edge 80*c* of wall panel 72*b* is removably connected to side edge 76*a* of top panel 72*c* by any of the attachment mechanisms described above. In FIG. 7, opposing Velcro pads 86 are provided for removably connecting edges 80*c* and 76*a*.

Although FIG. 7 illustrates that top edge 80*c* of wall panel 72*b* is removably connected to side edge 76*a* of top panel 72*c*, it is also possible to provide the removable connection between any two adjacent side edges of any of the panels 72*a*, 72*b*, 72*c*, 72*d* and 72*e*, with the other adjacent side edges hingedly connected to each other.

The opposite ends 88 and 90 of the structure 70 may be left open, or may be completely or partially covered with fabric wall pieces or triangular fabric corner pieces as described above for structure 50. Openings or slits may also be provided at one or more of the panels or fabric wall pieces.

The structure 70 is illustrated in the fully deployed configuration in FIG. 7. To fold and collapse the structure 70 into a compact configuration for storage or transportation, the user detaches the attachment mechanism between side edges 80*c* and 76*a*. The panels are then folded over each other about their hinge connections so that they form a stack of five overlying panels. The combined stack of panels are then twisted and folded in the manner described above in connection with FIGS. 5A–5E to collapse the structure 70 into a compact configuration.

Play structures 20, 50 and 70 are examples of simple structures that can be provided according to the present invention. However, it will be appreciated by those skilled in the art that structures having different and more complex configurations can also be provided according to the principles of the present invention. As a non-limiting example, structures having a larger number of panels and possible configurations can be provided. As another non-limiting example, while the panels of the structures according to the present invention are shown and described as having four sides, it is possible for each panel to have three or more sides. It is also possible to provide structures with a plurality of panels, each having a different number of sides. Thus, the structures of the present invention may take a variety of external shapes and sizes. However, each panel of the structure, regardless of its shape and size, is preferably supported by one continuous frame member.

In addition, although certain connections for the structures 20, 50 and 70 are described as being hinged connections, it is possible to provide the connection between any pair of adjacent side edges of the panels as a removable connection instead of the hinged connection. Therefore, while structures 20 and 70 are described as requiring at least one removable connection, it is possible to provide one or more of the hinged connections as removable connections. Also, although structures 20 and 70 are illustrated as having removable connections at certain specific side edges, it is understood that the removable connection can be provided at any adjacent side edges between two adjacent panels.

Similarly, while structure 50 is described as having four hinged connections and no removable connections, it is possible to provide one or more of the hinged connections as removable connections. The removable connections can be achieved by the attachment mechanisms described above. To fold and collapse a structure having panels connected by removable connections, the user merely removes these connections, and then folds and/or places the panels one on top of the other so that the panels of the structure overlie one another to form one stack of panels. The combined stack of panels are then twisted and folded in the manner described above in connection with FIGS. 5A–5E to collapse the structure into a compact configuration.

Thus, the structures according to the present invention may be provided in a variety of configurations in which the number of panels and the shape and size of the panels may be varied. The structures according to the present invention can be easily deployed and disassembled, and are easy to fold and collapse into a compact configuration for convenient storage or transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure having a deployed configuration and a collapsed configuration, comprising:

a base panel comprising separate first and second sides, a foldable frame member having a folded and an unfolded orientation, and a fabric material substantially covering the frame member to form the base panel when the frame member is in the unfolded orientation, with the fabric assuming the unfolded orientation of its associated frame member;

first and second wall panels, each wall panel comprising a bottom side, a foldable frame member having a folded and an unfolded orientation, and a fabric material substantially covering each frame member to form the panel for each frame member when the frame member is in the unfolded orientation, with the fabric assuming the unfolded orientation of its associated frame member;

wherein the bottom side of the first wall panel is connected to the first side of the base panel, and the bottom side of the second wall panel is connected to the second side of the base panel; and wherein the first and second sides of the base panel rest on a surface when the structure is in the deployed configuration.

2. The structure of claim 1, wherein the structure further comprises:

a removable attachment mechanism for removably connecting the first side of the base panel with the bottom side of the first wall panel.

3. The structure of claim 2, wherein each of the first and second wall panels further comprises a top side, and wherein the bottom side of the second wall panel is hingedly connected to the second side of the base panel, and the top sides of the first and second wall panels are hingedly connected to each other.

4. The structure of claim 2, wherein the base panel further comprises a first end edge, and the first and second wall panels each comprises a left side, the structure further comprising:

a first end defined by the first end edge of the base panel, and the left sides of the first and second wall panels; and a fabric covering attached to the left sides of the first and second wall panels to substantially cover the first end of the structure.

5. The structure of claim 4, further comprising a slit provided in the fabric covering, the slit defining two separate fabric portions having unconnected bottom edges.

6. The structure of claim 1, wherein each of the first and second wall panels further comprises a top side, and wherein the structure further comprises:

a removable attachment mechanism for removably connecting the top sides of the first and second wall panels to each other.

7. The structure of claim 1, wherein each panel comprises a frame retaining sleeve for retaining the respective frame member, and the frame retaining sleeve of the base panel is stitched at its second side to the frame retaining sleeve of the bottom side of the second wall panel to form a hinged connection.

8. A collapsible structure having a deployed configuration and a collapsed configuration, comprising:

first and second wall panels, each wall panel having a foldable frame member having a folded and an unfolded orientation, a fabric material substantially covering each frame member to form the panel for each frame member when the frame member is in the unfolded orientation, with the fabric assuming the unfolded orientation of its associated frame member, and a frame retaining sleeve for retaining the respective frame member;

the foldable frame member for each wall panel further defining a four-sided configuration having a top side, a bottom side, a left side connecting the top and bottom sides, and a right side connecting the top and bottom sides;

wherein the frame retaining sleeve of the first wall panel, is stitched along the length of its top side to the franc retaining sleeve along the length of the top side of the second wall panel to form a hinged connection;

a first fabric covering interconnecting the left sides of the first and second wall panels; and a second fabric covering interconnecting the right sides of the first and second wall panels.

9. The structure of claim 8, wherein the bottom side of each of the first and second wall panels rests on a surface when the structure is in the deployed configuration.

10. The structure of claim 8, further including a slit provided in the first fabric covering, the slit defining two fabric portions to create an opening.

11. The structure of claim 10, further including opposing Velcro pads provided on the two fabric portions to secure the two fabric portions together to close the opening.

12. A collapsible structure having a deployed configuration and a collapsed configuration, comprising:

first and second wall panels, each wall panel having a foldable frame member having a folded and an unfolded orientation, a fabric material substantially covering each frame member to form the panel for each frame member when the frame member is in the unfolded orientation, with the fabric assuming the unfolded orientation of its associated frame member, and a frame retaining sleeve for retaining the respective frame member;

the foldable frame member for each wall panel further defining a four-sided configuration having a top side, a bottom side, a left side connecting the top and bottom sides, and a right side connecting the top and bottom sides;

wherein the frame retaining sleeve of the first wall panel is stitched along the length of its top side to the frame retaining sleeve along the length of the top side of the second wall panel to form a hinged connection, and the bottom side of each of the first and second wall panels rests on a surface when the structure is in the deployed configuration;

a first fabric covering interconnecting the left sides of the first and second wall panels, the first fabric covering having a split defining two fabric portions to create an opening; and a second fabric covering interconnecting the right sides of the first and second wall panels.

13. The structure of claim 12, further including opposing velcro pads provided on the two fabric portions to secure the two fabric portions together to close the opening.

* * * * *